US010053813B2

(12) United States Patent
Hennig et al.

(10) Patent No.: US 10,053,813 B2
(45) Date of Patent: Aug. 21, 2018

(54) LAUNDRY TREATMENT APPARATUS COMPRISING A RECEIVING DEVICE

(71) Applicant: BSH HAUSGERÄTE GMBH, München (DE)

(72) Inventors: Holger Hennig, Berlin (DE); René Bedewitz, Berlin (DE); Andreas Thümmler, Hohen Neuendorf (DE)

(73) Assignee: BSH Hausgeräte GmbH, Munich (DE)

( * ) Notice: Subject to any disclaimer, the term of this patent is extended or adjusted under 35 U.S.C. 154(b) by 172 days.

(21) Appl. No.: 14/913,878

(22) PCT Filed: Jul. 31, 2014

(86) PCT No.: PCT/EP2014/066540
§ 371 (c)(1),
(2) Date: Feb. 23, 2016

(87) PCT Pub. No.: WO2015/024757
PCT Pub. Date: Feb. 26, 2015

(65) Prior Publication Data

US 2016/0201250 A1 Jul. 14, 2016

(30) Foreign Application Priority Data

Aug. 23, 2013 (DE) ..... 10 2013 216 748

(51) Int. Cl.
*E03C 1/18* (2006.01)
*D06F 58/22* (2006.01)
(Continued)

(52) U.S. Cl.
CPC ..... *D06F 58/22* (2013.01); *D06F 39/14* (2013.01); *D06F 39/12* (2013.01); *D06F 58/24* (2013.01)

(58) Field of Classification Search
CPC ..... A47L 15/4246
(Continued)

(56) References Cited

U.S. PATENT DOCUMENTS 5,940,986 A * 8/1999 Jelinek ..... D06F 58/04 34/528
6,941,678 B2 * 9/2005 Park ..... D06F 58/28 34/528
(Continued)

FOREIGN PATENT DOCUMENTS

DE 296 18 169 2/1998
DE 10 2010 039603 2/2012
(Continued)

OTHER PUBLICATIONS

International Search Report and Written Opinion for PCT/EP2014/066540, dated Oct. 10, 2014, 11 pages.

*Primary Examiner* — Matthew W Ing
(74) *Attorney, Agent, or Firm* — Nixon & Vanderhye P.C.

(57) ABSTRACT

A laundry treatment apparatus includes a receiving device into which a first functional component and a second functional component can be inserted. In one form, the receiving device includes a blocking element which is designed such that, when the first functional component is inserted, the second functional component can be moved into the receiving device up to a final position and, when the first functional component is not inserted, is designed such as to block movement to the final position.

18 Claims, 10 Drawing Sheets

Figure 1:
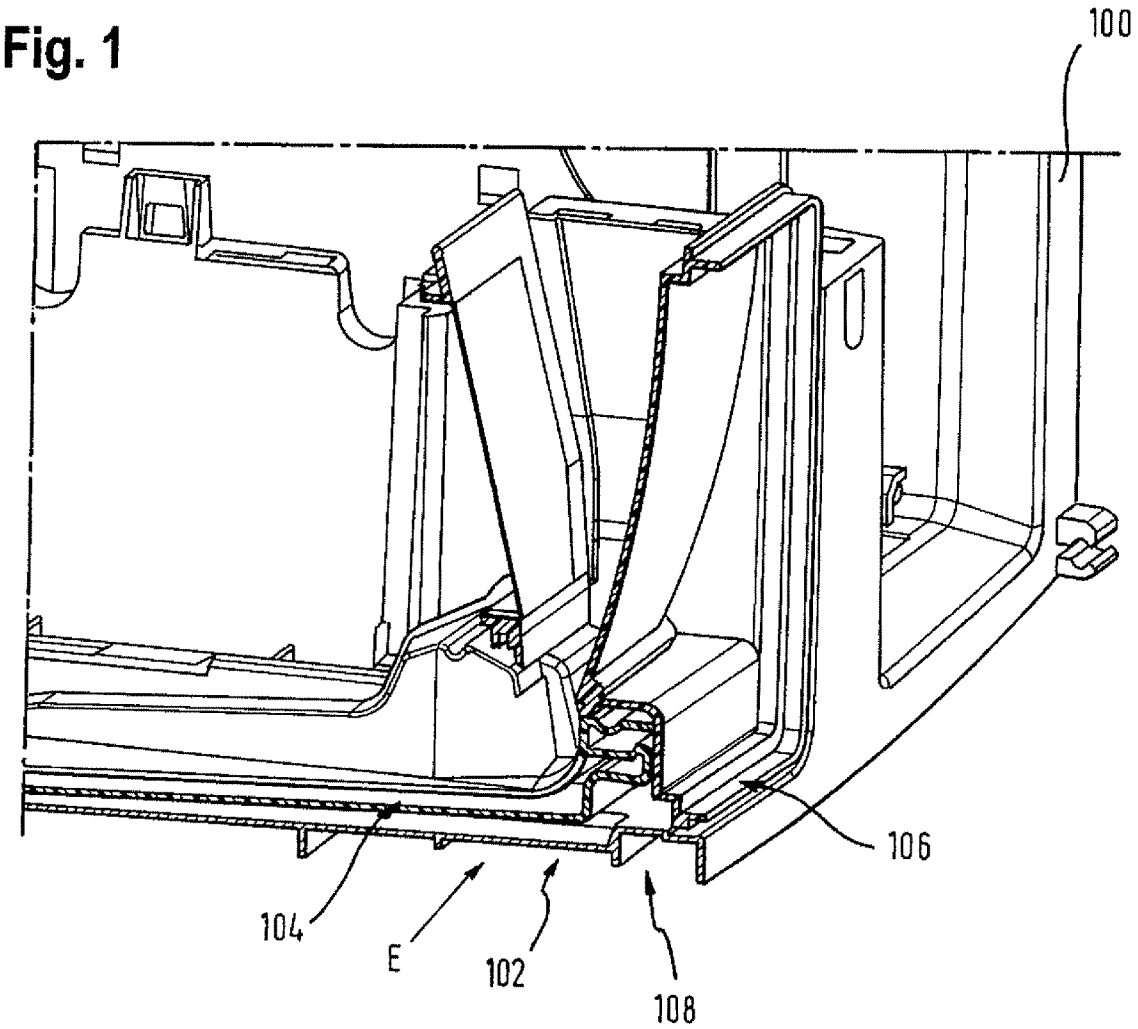

(51) Int. Cl.

| | |
|---|---|
| ***D06F 39/14*** | (2006.01) |
| *D06F 39/12* | (2006.01) |
| *D06F 58/24* | (2006.01) |

(58) Field of Classification Search
USPC ..... 312/228, 326, 329
See application file for complete search history.

(56) References Cited

U.S. PATENT DOCUMENTS

| | | | | |
|---|---|---|---|---|
| 9,250,016 | B2 * | 2/2016 | Kim | F26B 21/003 |
| 9,567,704 | B2 * | 2/2017 | Ros | D06F 58/22 |
| 2011/0016736 | A1 * | 1/2011 | Kim | D06F 58/22 34/82 |
| 2016/0053428 | A1 * | 2/2016 | Ros | D06F 58/22 34/82 |

FOREIGN PATENT DOCUMENTS

| | | | |
|---|---|---|---|
| EP | 0 250 789 | A1 | 1/1988 |
| EP | 0 443 361 | A1 | 8/1991 |
| EP | 2 055 825 | A1 | 5/2009 |
| EP | 2 055 826 | | 5/2009 |
| EP | 2 365 122 | | 9/2011 |
| GB | 2 318 408 | A | 4/1998 |

* cited by examiner

LAUNDRY TREATMENT APPARATUS COMPRISING A RECEIVING DEVICE

This application is the U.S. national phase of International Application No. PCT/EP2014/066540 filed 31 Jul. 2014, which designated the U.S. and claims priority to DE Patent Application No. 10 2013 216 748.2 filed 23 Aug. 2013, the entire contents of each of which are hereby incorporated by reference.

The invention relates to a laundry treatment appliance with a receiving device, to which two insertable functional components are assigned.

A laundry treatment appliance with a receiving device for different functional components, for example a lint filter and a retention trough for any resulting fluids, is known from DE 10 2010 039 603 A1. In order to ensure correct operation of the laundry treatment appliance, such functional components are generally removed on a regular basis for maintenance or cleaning purposes. The reinsertion of such functional components can be prone to error, particular if a number of functional components have to be inserted into the same receiving device and one of the functional components is forgotten. This can cause the functioning of the laundry treatment appliance to be disrupted or can even cause fluids to escape in an undesirable manner.

It is the object of the present invention to create a laundry treatment appliance with which it is possible to avoid the incorrect insertion of previously removed functional components.

This object is achieved by the subject matter having the features as claimed in the independent claim. Advantageous developments are set out in the dependent claims, the description and the drawings.

The invention laundry treatment appliance has a receiving device, into which a first functional component and a second functional component can be inserted, the receiving device having a blocking facility which is configured to allow displacement of the second functional component into the receiving device up to a final position when the first functional component is inserted and is configured to block displacement to the final position when the first functional component is not inserted. This has the technical advantage that the presence of the first functional component is identified, thereby reliably preventing incorrect assembly and operation without the first functional component being inserted.

A laundry treatment appliance refers in particular to a domestic appliance, for example a washing machine, a tumble dryer, a washer dryer or spin dryer. A washing machine is a domestic appliance for cleaning textiles in a domestic context, the textiles to be cleaned being cleaned in a rotatable drum. The washing machine therefore serves to eliminate dirt from the textiles. A tumble dryer is a domestic appliance which is used to dry damp textiles by machine in a short time by supplying warm air, the textiles to be dried being dried in a rotatable drum. A washer dryer finally is the combination of a tumble dryer and automatic washing machine in one domestic appliance and allows textiles to be cleaned and dried in the same rotatable drum. A spin dryer is a domestic appliance with a rotatable drum which is used for the preliminary drying of damp textiles using centrifugal force.

According to one embodiment the receiving device has a blocking element, the first functional component has a ramp element and the second functional component has a latch element, it being possible for the latch element to be deflected from a rest position to a release position by the ramp element of the first functional component inserted into the receiving device when the second functional component is inserted into the receiving device, it being possible for the second functional component to be displaced into the receiving device up to a final position in the release position and when the first functional component is not inserted the latch element of the second functional component being in the rest position, in which displacement to the final position is blocked by the blocking element. This has the technical advantage that the blocking facility has a particularly simple structure without electrical components, for example sensors and/or actuators, which also functions reliably without an electrical supply voltage.

According to a further advantageous embodiment the latch element is tension-free in the rest position and when the second functional component is in the final position. After insertion of the functional components the latch element therefore returns to a tension-free initial state, referred to as the rest state. This has the technical advantage that material-specific effects due to continuous tensioning are avoided. This has the technical advantage of increasing the service life of the latch element.

In a further advantageous embodiment the receiving device and/or the first functional component and/or the second functional component are made of plastic. This has the technical advantage that the receiving device and the two functional components can be produced in large numbers with little outlay and therefore at low cost.

In a further advantageous embodiment the first functional component and the ramp element are configured as a single piece and/or of the same material. This has the technical advantage that the functional component is extremely strong, thereby increasing the service life of the workpiece.

In a further advantageous embodiment the second functional component and the latch element are configured as a single piece and/or of the same material. This has the technical advantage that the functional component is extremely strong, thereby increasing the service life of the workpiece.

In a further advantageous embodiment the receiving device and the blocking element are configured as a single piece and/or of the same material. This has the technical advantage that the functional component is extremely strong, thereby increasing the service life of the workpiece.

In a further advantageous embodiment the latch element is configured to be elastically deformable. This has the technical advantage that the latch element can be moved by elastic deformation alone and no bearing has to be provided on the latch element.

In a further advantageous embodiment the blocking element has a ramp region for interacting with the latch element. This has the technical advantage that the blocking element, in addition to its blocking function, can also deflect the latch element, in particular during the removal of the second functional component from the receiving device, and there is therefore no need to provide a further ramp element.

In a further advantageous embodiment the blocking device is configured to transmit force acting on the second functional component to the first functional component when the second functional component is removed from the receiving device from the final position. This has the technical advantage that the first functional component and the second functional component can be removed from the receiving device together in one work step. This improves ease of operation.

In a further advantageous embodiment the blocking facility has a lever element, the lever element being assigned to the latch element and the lever element being able to be deflected into a latching position when the second functional component is removed from the receiving device, the latch element being in contact with the first functional component in the latching position. This has the technical advantage that a force required for the elastic deformation of the entire latch element can only be transmitted to the latch element by means of the lever element, with the result that friction forces only occur at the lever element and are therefore small.

In a further advantageous embodiment the ramp element has a contact surface, which can be brought into contact with the lever element. This has the technical advantage that force is transmitted from the second functional component to the first functional component in a structurally simple manner. Both functional components can therefore be removed in one work step.

In a further advantageous embodiment the first functional component can be inserted along an assembly direction x and the second functional component can be removed along a removal direction, the assembly direction and the removal direction being arranged in opposition to one another. This has the technical advantage that the functional components can only be inserted into the receiving device and then removed again in a predefined manner. This avoids errors during insertion.

The object of the invention is further achieved by such a receiving device for a laundry treatment appliance. This has the technical advantage that the presence of the first functional component is identified even though no sensors or actuators have been incorporated. Such a laundry treatment appliance can be produced at lower cost.

The object of the invention is also achieved by such a functional component for a laundry treatment appliance. This has the technical advantage that presence is identified even though no sensors or actuators have been incorporated.

Figure 2:
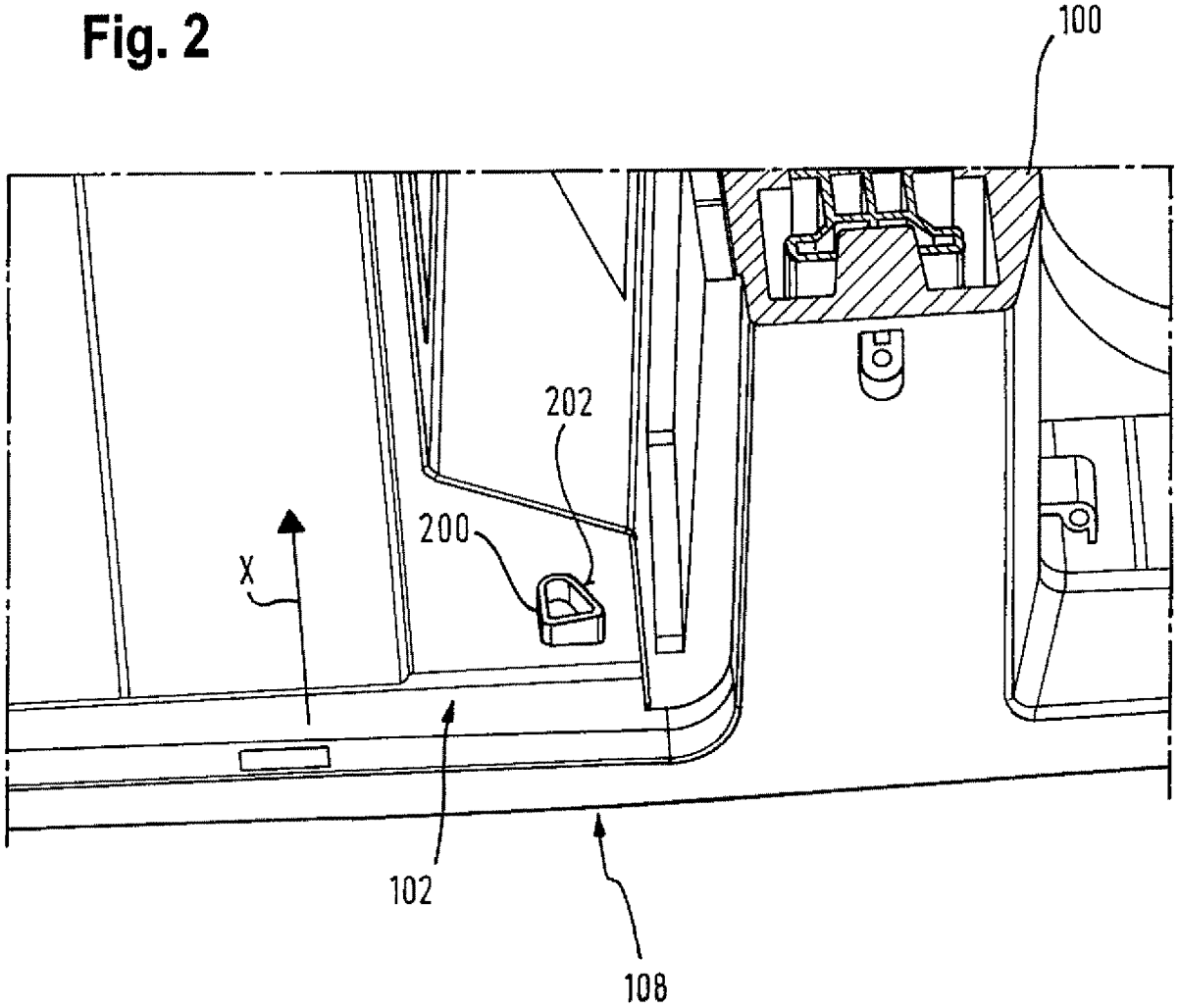
Figure 3:
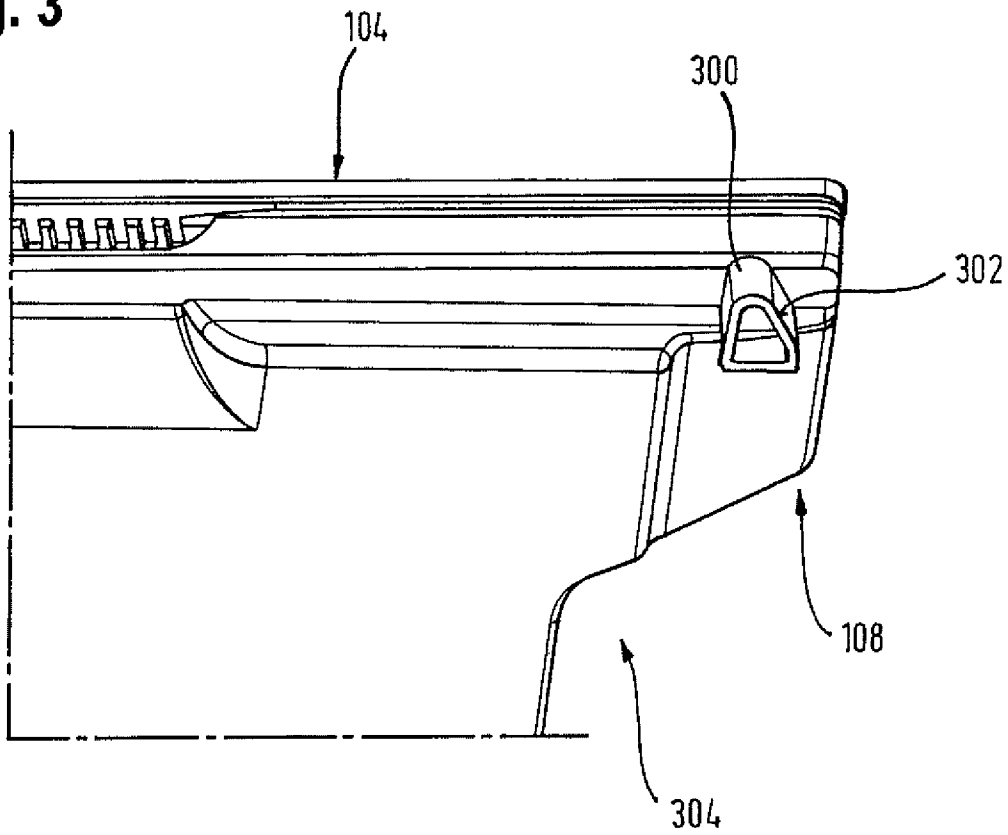
Figure 4:
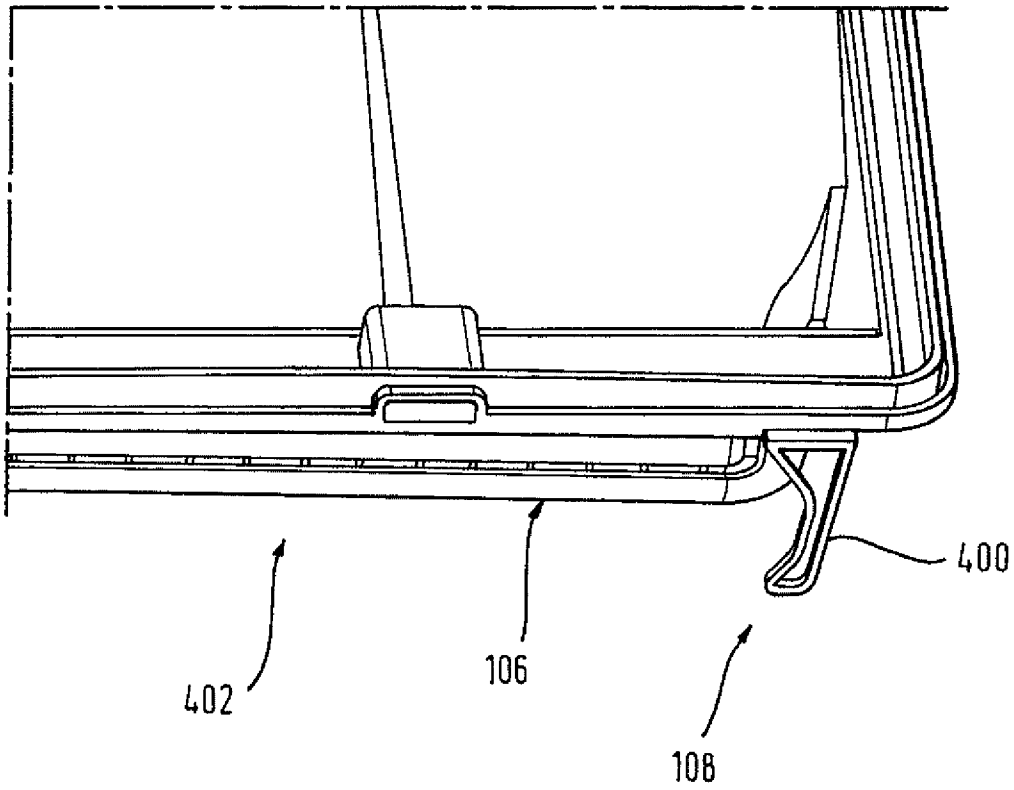
Figure 5:
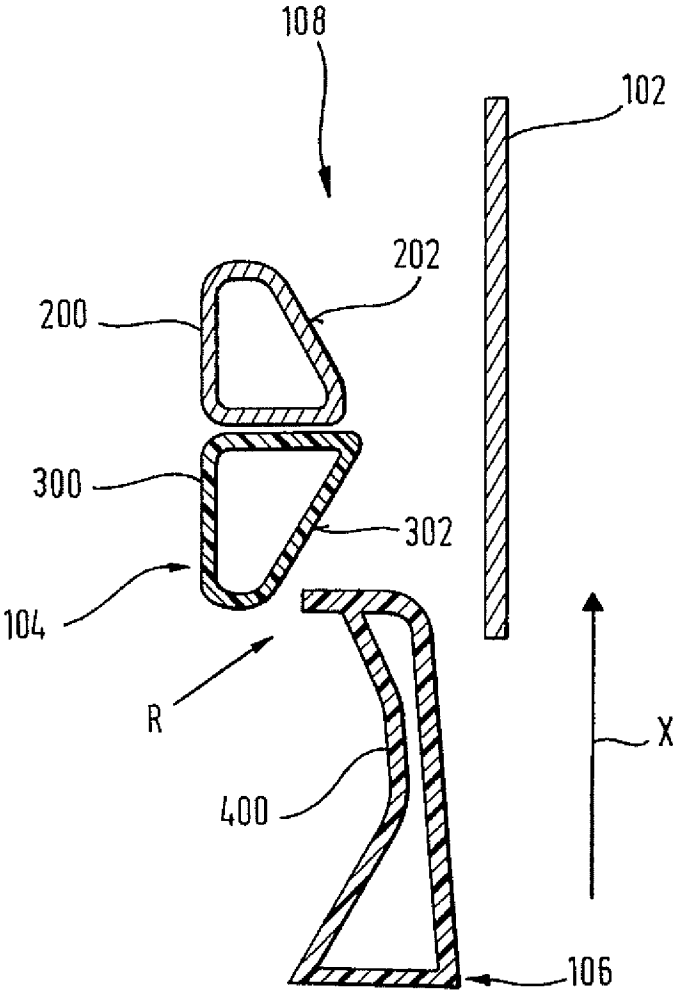
Figure 6:
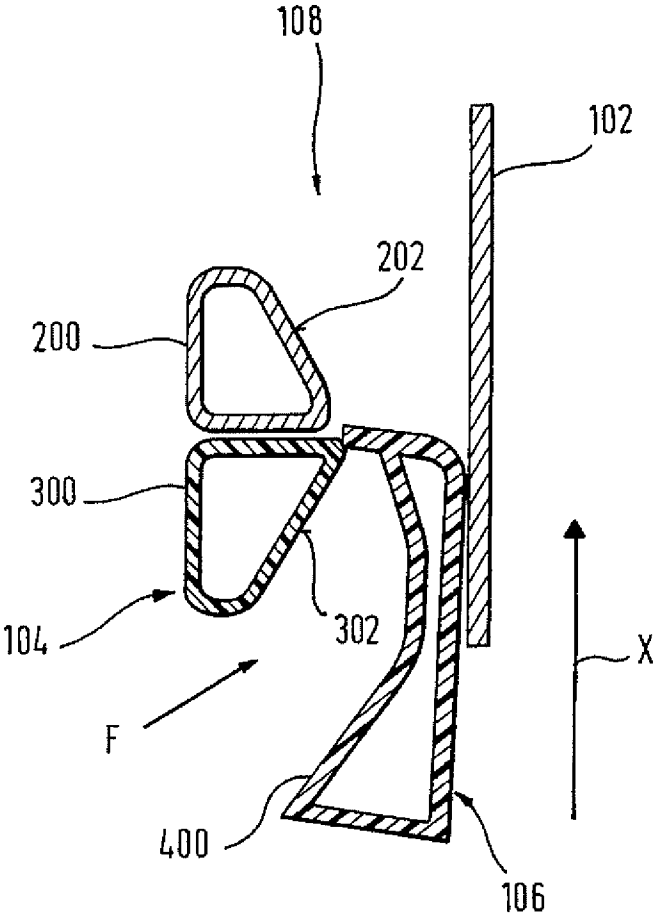
Figure 7:
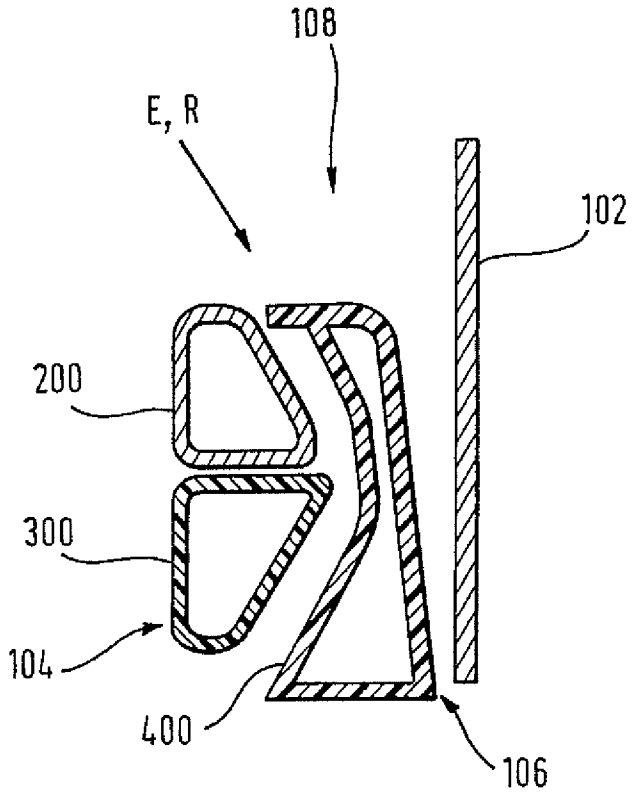
Figure 8:
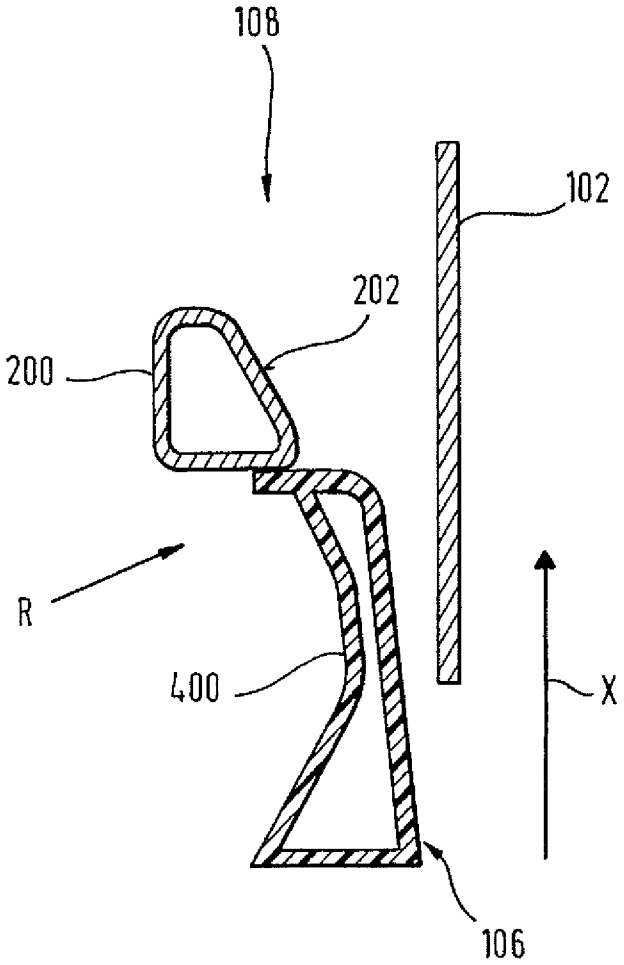
Figure 9:
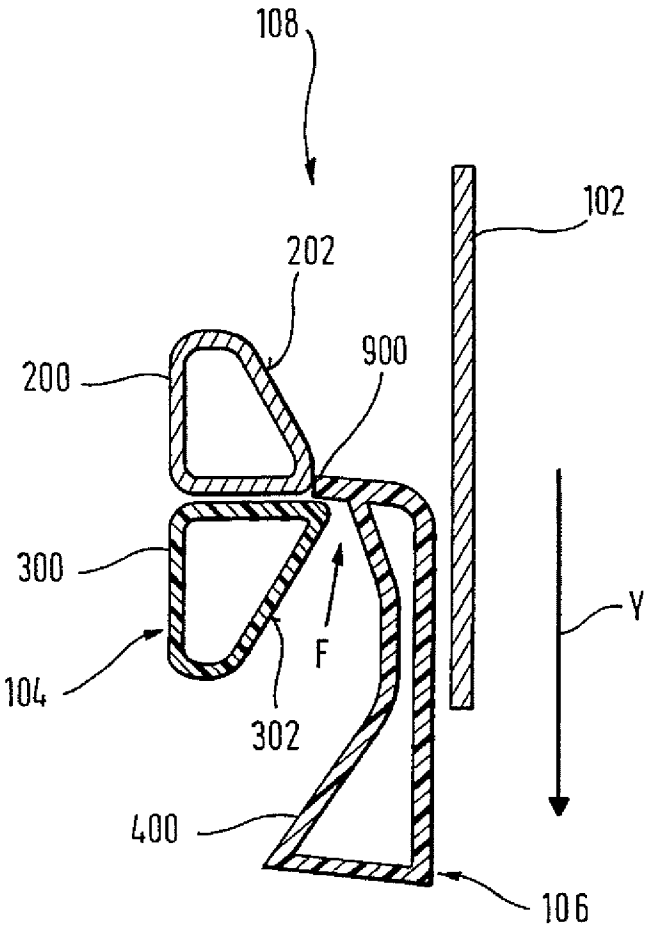
Figure 10:
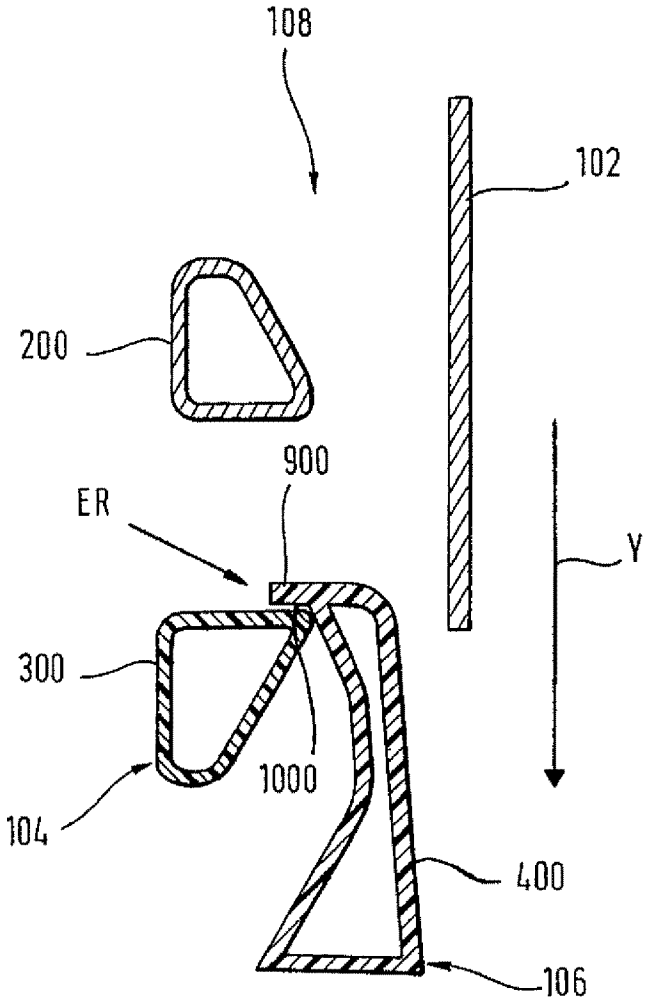

Exemplary embodiments are explained with reference to the accompanying drawings, in which:

FIG. 1 shows a perspective view of a laundry treatment appliance with functional components inserted, FIG. 2 shows a detail from FIG. 1 but without functional components inserted, FIG. 3 shows an oblique view of the lower face of a first functional component, FIG. 4 shows an oblique view of the lower face of a second functional component, FIG. 5 shows a schematic sectional view through a receiving device with a first functional component and a second functional component during a first assembly step, FIG. 6 shows a schematic sectional view through a receiving device with a first functional component and a second functional component during a second assembly step, FIG. 7 shows a schematic sectional view through a receiving device with a first functional component and a second functional component, after assembly, FIG. 8 shows a schematic sectional view through a receiving device with a second functional component during an assembly attempt, FIG. 9 shows a schematic sectional view through a receiving device with a first functional component and a second functional component during a first step to remove the second functional component, FIG. 10 shows a schematic sectional view through a receiving device with a first functional component and a second functional component during a second removal step.

FIG. 1 shows a perspective view of a laundry treatment appliance 100.

According to one embodiment the laundry treatment appliance 100 is a domestic appliance, for example a washing machine, a tumble dryer, a washer dryer or a spin dryer. A washing machine is a domestic appliance for cleaning textiles in a domestic context, the textiles to be cleaned being cleaned in a rotatable drum. The washing machine therefore serves to eliminate dirt from the textiles. A tumble dryer is a domestic appliance which is used to dry damp textiles by machine in a short time by supplying warm air, the textiles to be dried being dried in a rotatable drum. A washer dryer finally is the combination of a tumble dryer and automatic washing machine in one domestic appliance and allows textiles to be cleaned and dried in the same rotatable drum. A spin dryer is a domestic appliance with a rotatable drum which is used for the preliminary drying of damp textiles by machine using centrifugal force.

The laundry treatment appliance 100 has a receiving device 102, into which a first functional component 104 and a second functional component 106 are inserted. According to one embodiment the first functional component 104 is a combination of a lint filter and a condensate collector. According to one embodiment the second functional component 106 is a lint filter through which air flows.

According to one embodiment the laundry treatment appliance 100 also has a blocking facility 108. According to one embodiment the blocking facility 108 is configured to allow displacement of the second functional component 106 up to its final position E in the receiving device 102, when the first functional component 104 is inserted in the receiving device 102. According to one embodiment the blocking facility 108 is also configured to block displacement of the second functional component 106 up to its final position E in the receiving device 102, when the first functional component 104 is not inserted in the receiving device 102.

FIG. 2 shows a detail from FIG. 1 without the first functional component 104 and without the second functional component 106. The receiving device 102 can be seen in particular.

According to one embodiment the receiving device 102 has a blocking element 200 that belongs to the blocking facility 108. According to one embodiment the receiving device 102 and the blocking element 200 are configured as a single piece and of the same material. According to one embodiment the receiving device 102 and the blocking element 200 are made of plastic, for example by means of an injection molding process.

According to one embodiment the blocking element 200 has a ramp region 202. The mode of operation of the ramp region 202 is explained below with reference to FIG. 9.

The arrow in FIG. 2 shows the assembly direction x, in which the first functional component 104 and the second functional component 106 are to be displaced into the receiving device 102 so that they can assume the final position E shown in FIG. 2. According to one embodiment the receiving device 102 is configured such that the first functional component 104 and the second functional component 106 are to be inserted one after the other into the receiving device 102 in the assembly direction (x). According to one embodiment the first functional component 104 is inserted first, followed by the second functional component 106.

FIG. 3 shows an oblique view of a lower face 304 of the first functional component 104.

According to one embodiment the first functional component 104 according to one embodiment has a ramp element 300 belonging to the blocking facility 108.

According to one embodiment the first functional component 104 and the ramp element 300 are configured as a single piece and of the same material. According to one embodiment the first functional component 104 and the ramp element 300 are made of plastic, for example by means of an injection molding process.

It can also be seen from FIG. 3 that according to one embodiment the ramp element 300 has an angled insertion section 302.

FIG. 4 shows an oblique view of a lower face 402 of the second functional component 106.

According to one embodiment the second functional component 106 has a latch element 400 that belongs to the blocking facility 108 according to one embodiment.

According to one embodiment the second functional component 106 and the latch element 400 are configured as a single piece and of the same material. According to one embodiment the second functional component 106 and the latch element 400 are made of plastic, for example by means of an injection molding process.

FIGS. 5 and 6 show schematic sectional views through the blocking facility 108 with the inserted first functional component 104 and the second functional component 106 during a first step to assemble the second functional component 106.

During insertion of the second functional component 106 in assembly direction x the ramp element 300 of the first functional component 104 brings about elastic deformation of the latch element 400 configured on the second functional component 106 with its angled run-up section 302. The latch element 400 becomes increasingly deformed during insertion in the assembly direction x along the angled run-up section 302 from a rest position R (FIG. 5) up to a release position F (FIG. 6). In the release position F the latch element 400 can pass the blocking element 200.

FIG. 7 shows a schematic sectional view through the receiving device 102 with the first functional component 104 and the second functional component 106 in their final position E in the receiving device 102.

In the state shown in FIG. 7 the latch element 400 is back in the initial position, in other words in its rest position R, and is therefore tension-free according to one embodiment. The freedom from tension of the elastically deformable latch element 400 means that material-specific effects due to continuous tensioning are avoided. This increases the service life of the latch element 400.

FIG. 8 shows a schematic sectional view through the receiving device 102 with the blocking facility 108 during assembly of the second functional component 106 in assembly direction x. The first functional component 104 is however not inserted in FIG. 8.

It can be seen from FIG. 8 how the latch element 400 configured on the second functional component 106 is blocked by the blocking element 200 configured on the receiving device 102. In FIG. 8 the latch element 400 is in the rest position R, in which it comes up against the ramp region 202. Further displacement in the assembly direction x is therefore not possible.

FIG. 9 shows a schematic sectional view through the receiving device 102 with the first functional component 104 and the second functional component 106 during a first step to remove the second functional component 106.

According to one embodiment the blocking facility 108 is configured to transmit force acting on the second functional component 106 to the first functional component 104 when the second functional component 106 is removed from the receiving device 102 from the final position E. Thus according to one embodiment the first functional component 104 and the second functional component 106 can be removed from the receiving device 102 together.

According to one embodiment the latch element 400 has a lever element 900. According to one embodiment the latch element 400 and the lever element 900 are configured as a single piece and of the same material. According to one embodiment the latch element 400 and the lever element 900 are made of plastic, for example by means of an injection molding process.

When the second functional component 106 is displaced in the removal direction y for its removal from the receiving device 102, the lever element 900 runs down the ramp region 202 of the blocking element 200. The latch element 400 is deflected from the final position E into a latching position ER in this process. According to one embodiment the latch element 400 is deformed elastically in this process.

FIG. 10 shows a schematic sectional view through the receiving device 102 with the first functional component 104 and the second functional component 106 during a second step to remove the second functional component 106.

The latch element 400 with the lever element 900 configured thereon is in the latching position ER. This means that a contact surface 1000 of the lever element 900 is in contact with the first functional component 104. According to one embodiment the contact surface 1000 of the lever element 900 is formed by an indentation. If the second functional component 106 is now displaced in removal direction y, a force acting on the second functional component 106 can be transmitted from the second functional component 106 to the first functional component 104 by means of the contact surface 1000. The first functional component 104 is therefore displaced together with the second functional component 106 in removal direction y. According to this exemplary embodiment force is transmitted from the second functional component 106 to the first functional component 104 in a structurally simple manner. The first functional component 104 and the second functional component 106 can therefore be removed together in one work step. According to this exemplary embodiment the assembly direction x and the removal direction y in FIGS. 9 and 10 are on the same axis. According to one embodiment the assembly direction x and the removal direction y are aligned in opposition to one another, in other words they are aligned antiparallel to one another. After a removal the contact surface 1000 can be separated from the ramp region 300 without further ado.

The present blocking facility 108 allows the presence of the first functional component 104 to be identified, thereby avoiding operation of the laundry treatment appliance 100 with the first functional component 104 missing.

LIST OF REFERENCE CHARACTERS

100 Laundry treatment appliance
102 Receiving device
104 First functional component
106 Second functional component
108 Blocking facility
200 Blocking element
202 Ramp region
300 Ramp element
302 Angled insertion section
304 Lower face

400 Latch element
402 Lower face
900 Lever element
1000 Contact surface
R Rest position
F Release position
E Final position
ER Latching position
x Assembly direction
y Removal direction

The invention claimed is:

1. A laundry treatment appliance, with a receiving device, into which a first functional component and a second functional component are insertable, wherein the receiving device has a blocking facility which is configured to allow displacement of the second functional component into the receiving device up to a final position when the first functional component is inserted and is configured to block displacement of the second functional component to the final position when the first functional component is not inserted, wherein the receiving device has a blocking element, the first functional component has a ramp element and the second functional component has a latch element, wherein during insertion of the second functional component the ramp element of the first functional component is configured to directly engage and deflect the latch element from a rest position to a release position, wherein the second functional component is displaceable into the receiving device up to the final position in the release position and when the first functional component is not inserted the latch element of the second functional component being in the rest position, in which displacement to the final position is blocked by the blocking element.

2. The laundry treatment appliance as claimed in claim 1, wherein the latch element is tension-free in the rest position and in the final position.

3. The laundry treatment appliance as claimed in claim 1, wherein at least one of the receiving device, the first functional component, and the second functional component is made of plastic.

4. The laundry treatment appliance as claimed in claim 1, wherein first functional component and the ramp element are configured as at least one of a single piece and of the same material.

5. The laundry treatment appliance as claimed in claim 1, wherein the second functional component and the latch element are configured as at least one of a single piece and of the same material.

6. The laundry treatment appliance as claimed in claim 1, wherein the receiving device and the blocking element are configured as at least one of a single piece and of the same material.

7. The laundry treatment appliance as claimed in claim 1, wherein the latch element is configured to be elastically deformable.

8. The laundry treatment appliance as claimed in claim 1, wherein the blocking element has a ramp region for interacting with the latch element.

9. The laundry treatment appliance as claimed in claim 1, wherein the first functional component is insertable along an assembly direction and the second functional component is removable along a removal direction, wherein the assembly direction and the removal direction are arranged in opposition to one another.

10. A laundry treatment appliance, with a receiving device, into which a first functional component and a second functional component are insertable, wherein that the receiving device has a blocking facility which is configured to allow displacement of the second functional component into the receiving device up to a final position when the first functional component is inserted and is configured to block displacement to the final position when the first functional component is not inserted, wherein the receiving device has a blocking element, the first functional component has a ramp element and the second functional component has a latch element, it being possible for the latch element to be deflected from a rest position to a release position by the ramp element of the first functional component inserted into the receiving device when the second functional component is inserted into the receiving device, wherein it is possible for the second functional component to be displaced into the receiving device up to the final position in the release position and when the first functional component is not inserted the latch element of the second functional component being in the rest position, in which displacement to the final position is blocked by the blocking element wherein the blocking facility is configured to transmit force acting on the second functional component to the first functional component when the second functional component is removed from the receiving device from the final position.

11. The laundry treatment appliance as claimed in claim 10, wherein the blocking facility has a lever element, wherein the latch element includes the level element and the lever element being deflectable into a latching position when the second functional component is removed from the receiving device, the latch element being in contact with the first functional component in the latching position.

12. The laundry treatment appliance as claimed in claim 11, wherein the ramp element has a contact surface, which can be brought into contact with the lever element.

13. A laundry treatment appliance comprising:

a receiving device with a stationary blocking element, the blocking element including a blocking surface;

a first functional component including an engaging surface, the first functional component being insertable into the receiving device;

a second functional component including a latch element, the second functional component insertable into the receiving device;

wherein in a first configuration the first functional component is located within the receiving device and the second functional component is insertable to a working position, and during insertion of the second functional component the latch element of the second functional component is configured to contact the engaging surface of the first functional component such that the engaging surface deflects the latch element of the second functional component, and permits the second functional component to be insertable to the working position; and wherein in a second configuration the first functional component is not located within the receiving device, wherein during insertion of the second functional component the blocking surface of the blocking element is configured to engage the latch element and prevent the second functional component from being displaced to the working position.

14. The laundry treatment appliance according to claim 13, wherein the blocking surface is stationary with respect to the receiving device.

15. The laundry treatment appliance according to claim 13, wherein the latch element further comprises a lever element, wherein during removable of the second functional component from the working position, the lever element engages with the first functional component such that the first functional component and the second functional component removable from the receiving device simultaneously.

16. The laundry treatment appliance according to claim 13, wherein during insertion of the second functional component in the first configuration, the first function component is configured to elastically deform the latch element.

17. The laundry treatment appliance according to claim 13, wherein the blocking surface has a height, wherein in the first configuration the first functional component is configured to displace the latch element a distance which is greater than the height of the blocking surface.

18. The laundry treatment appliance according to claim 13, wherein the blocking element is configured to remain stationary during removal of the second functional component from the working position.

* * * * *